US006810218B1

(12) United States Patent
Wong et al.

(10) Patent No.: US 6,810,218 B1
(45) Date of Patent: Oct. 26, 2004

(54) ESTIMATION OF TONER USAGE

(75) Inventors: Kaiser H. Wong, Torrance, CA (US); Lawrence P. Chen, Torrance, CA (US); Walter F. Filbrich, Manhattan Beach, CA (US); Philip G. Hardjadinata, Fullerton, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/662,252

(22) Filed: Sep. 15, 2003

(51) Int. Cl.[7] ..... G03G 15/08
(52) U.S. Cl. ..... 399/27
(58) Field of Search ..... 399/27, 24

(56) References Cited

U.S. PATENT DOCUMENTS 4,811,115 A * 3/1989 Lin et al. ..... 382/192
5,349,377 A 9/1994 Gilliland et al. ..... 346/153
5,867,198 A 2/1999 Gwaltney et al. ..... 347/131

FOREIGN PATENT DOCUMENTS

JP 09321990 A * 12/1997 ..... H04N/1/409

* cited by examiner

*Primary Examiner*—Quana Grainger
(74) *Attorney, Agent, or Firm*—Oliff & Berridge, PLC

(57) ABSTRACT

A method for estimation of toner usage in digital xerographic process is disclosed. The method calculates a ratio of transition count/pixel count using a pixel transition count and a pixel count for a printed image and provides an estimate of toner consumption based on the ratio of transition count/pixel count.

22 Claims, 2 Drawing Sheets

FIG. 2A

40

| 42 | 44 Pure Solid | 46 Pure Text | 48 Pure Halftone |
|---|---|---|---|
| Ratio of Transition Counts/Pixel Counts | R3 | R1 | R2 |
| Toner Mass/Pixel | M3 | M1 | M2 |

43

FIG. 2B

50

| 55 | 44 Solid | | | 46 Text | | | 48 Halftone | | |
|---|---|---|---|---|---|---|---|---|---|
| Look Up Number | 1 | 2 | 3 | 4 | 5 | 6 | 7 | 8 | 9 |
| Ratio of Transition Counts/Pixel Counts | | R3 | | R4 | R1 | | | R2 | |
| Toner Mass/Pixel | | M3 | | M4 | M1 | | | M2 | |

43 42

FIG. 2C

60

| 55 | 44 Solid | | | 46 Text | | | 48 Halftone | | |
|---|---|---|---|---|---|---|---|---|---|
| Look Up Number | 1 | 2 | 3 | 4 | 5 | 6 | 7 | 8 | 9 |
| Ratio of Transition Counts/Pixel Counts | 0.001 | 0.01 | 0.09 | 0.10 | 0.40 | 0.50 | 0.60 | 0.80 | 1.00 |
| Toner Mass/Pixel (nanograms) | a | b | c | d | e | f | g | h | i |

43 42

ESTIMATION OF TONER USAGE

BACKGROUND

A method to create toner gas gauge by using both pixel count and pixel transition count for different types of image is disclosed. Using the ratio of transition count to pixel count develops an accurate estimation than simple pixel counting of toner consumption based on image types. Due to fringe field development effect, different type of image consumes different toner mass for the same number of pixel counts. By monitoring the transition counts (laser on/off or off/on) a determination can be made as to what type of image is being exposed on a photoreceptor resulting in a better estimation of toner usage.

In a typical electrophotographic printing process, a photoconductive member is charged to a substantially uniform potential so as to sensitize the surface thereof. The charged photoconductive member is selectively exposed to dissipate the charges thereon in the irradiated areas. This records an electrostatic latent image on the photoconductive member. After the electrostatic latent image is recorded on the photoconductive member, the latent image is developed by bringing a developer material into contact therewith. The toner particles are attracted to the latent image forming a toner powder image on the photoconductive member. The toner powder image is then transferred from the photoconductive member to a copy sheet. The toner particles are heated to permanently affix the powder image to the copy sheet.

In digital xerographic printers and copiers, the process control software has available the actual number and distribution of pixels in every image. Pixel-counting can and has been used to estimate the amount of toner used in developing a given image. The estimated value representing the amount of toner consumed is used for controlling the addition of toner to the developer housing in a dual component development system, and to indicate the remaining toner left in the EP cartridge in a single component development system.

In a dual component development system, for example, to maintain print quality, toner concentration usually is maintained during machine operation. This may involve adding toner to the developer housing in a controlled fashion during the entire imaging sequence. In a single component development system, toner consumption is usually monitored and a warning signal is given to the user when the condition of "End of Life" is nearly approached. In a digital xerographic engine, the number of pixels printed can be roughly correlated to the amount of toner to be used. When using simple pixel counting, the area of pixels developed is taken as fully developed, that is, toner mass developed can be calculated according to the following equation:

$$M_t = N_p * A_p * DMA_{max}$$

where:

$M_t$ is the mass of toner developed $N_p$ is the number of pixels developed $A_p$ is the area of each pixel $DMA_{max}$ is the maximum Developed Toner Mass Area which can be developed.

This equation, however, fails to account for the different types of images such as text/line, half tone and solid area printed which will yield different toner mass consumptions, and therefore the estimation generated from this equation may be inaccurate.

SUMMARY

A method for estimation of toner usage in digital xerographic process is disclosed. The method calculates a ratio of transition count/pixel count using a pixel transition count and a pixel count for a printed image and provides an estimate of toner consumption based on said ratio of transition count/pixel count.

BRIEF DESCRIPTION OF THE DRAWINGS

FIG. 2A is a look-up table defining the relationship between pixel/transition counting versus different types of images.

FIG. 2B is the look-up table of FIG. 2A refined for more accurate results.

FIG. 2C illustrates an example of the look-up table of FIG. 2B having ratio values.

DETAILED DESCRIPTION

Figure 1:
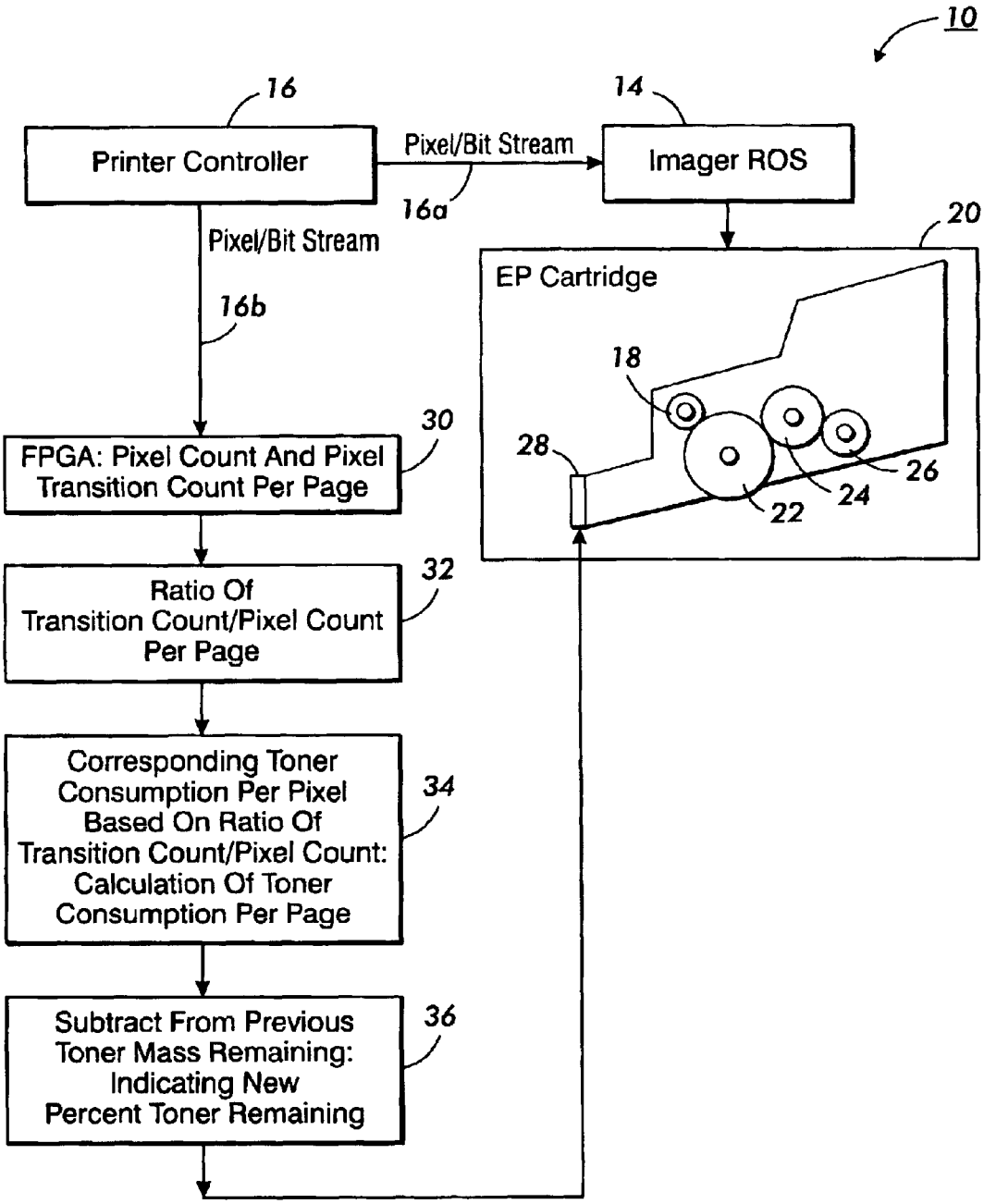
FIG. 1 is a schematic view and flowchart of one exemplary printer imaging material usage calculation system.

FIG. 1 is a schematic view and flowchart of one exemplary printer imaging material usage calculation system. The system disclosed and shown in FIG. 1 is a single component non-magnetic toner development system. Image developer material (e.g., toner) consumption monitoring may be provided for various electrostatographic electronic printing and/or digital copying machines in which an electrostatic latent image is electrically formed on an imaging member by various image generators, such as a laser beam, an LED array or bar, biased electrodes, ion emitters, printing heads or the like, for imaging of digital image input signals to form latent images on the imaging member which are then developed with a known image developer material. The imaging member may be a photo-conductor drum or belt. The developed image is then normally transferred to a copy sheet. This system can be used with color and/or black and white printers.

Referring to FIG. 1, an electronic printer 10 is shown schematically, with a organic photo-conductor drum 22 charged by a charge roller 18. The surface of the photoconductor is imaged by an imager ROS 14 (Raster Optical Scanner), such as on/off scanning laser, driven by a printer controller 16. The latent image formed may be developed by a developer roller 24 fed toner by a supply roller 26. Toner consumption data is stored in a CRUM 28 (Customer Replaceable Unit Monitor) comprising an electrical erasable programmable read only memory (EEPROM). The above-numbered items may all be conventional and are known, and thus need not be further described in detail herein.

Referring once again to FIG. 1, the printer controller 16 generates the image to be printed in an electronic pixel (or bit) stream (video data) 16*a* to the imager ROS 14, which here is also tapped at 16*b* and sent to a Field—Programmable Gate Array (FPGA) unit 30 where both pixels count and transition count per page are counted (30). The function of the Field—Programmable Gate Array (FPGA) is to interface between the controller and the print engine. Video data being sent to the engine is also sent to the pixel counter in the FPGA and this pixel counter keeps track "On" pixel on the page. Another counter in the FPGA is the transition counter register which counts only "1 to 0" or "0 to 1" transition in horizontal scan direction. Next, the ratio of transition count/pixel count per page is calculated (32) in the controller. This directly provides a corresponding consumption per pixel based on the ratio of transition count/ pixel count (34) resulting in a calculation of toner consumption per page. The calculation of toner consumption per page (34) is in turn subtracted from the previous toner mass remaining (36) indicating a new percent of toner remaining.

The toner consumption per pixel for different types of images is initially determined experimentally to estimate the toner consumption per page and subsequently remaining toner in the toner gas gauge. The toner mass consumption per pixel and ratio of transition counts/pixel counts for text, half tone and solid areas images will vary with the particular printer, and should be empirically determined by counting pixels and transitions and measuring toner usage for different types of image in a test machine (under conditions of suitable area image coverage and density). That is, the "fringe-field" effect will vary with different printers due to differences in the photoreceptor, its charge/discharge levels, the development and developer bias level system, the toner, etc. Also, the transition count and pixel count for any given image may vary between printers due to differences in the imager spot size and spacing or resolution (pixels per inch) and the scanning rate (the sweep rate of the laser beam or on/off rate and LED spacing of the LED image bar).

For a given printer, to obtain toner mass consumption per pixel and the ratio of transition counts/pixel counts for pure text the following procedure (a) through (f) is used as an exemplary illustration:

(1) Pure Text:

Test Pattern to be used: File No.1

No. of pixels in the file=1.345 Millions

Procedure:

(a) Weigh the CRU (Toner cartridge) before running experiment (e.g. 2500 grams).

(b) Print 1000 prints on Letter/A4 size paper.

(c) After the test, obtain the number of pixels and transition counts in the usage profile of the engine and determine the ratio of transition counts/pixel counts.

(d) Weigh the CRU after finishing 1000 prints.

(e) Obtain the toner mass consumption per 1000 prints and then toner mass consumption for one print and then toner mass consumption per pixel (Toner mass consumption per print divided by number of pixels per print ) in Ng (Nanogram: $10^{-9}$ gram) per pixel (f) Repeat (a) through (e) 5 times and get the average toner mass consumption per pixel as M1 and get the average ratio of transition counts/pixel counts as R1.

The values above and throughout this disclosure where chosen for illustration purposes only and are examples. For instance, 1,000 prints may be any large number of prints and the procedure may be repeated and desired number of times in (f) and not limited to 5. Pure text, pure halftone and pure solid refer to a standard pattern comprised of text, halftone and solid images separated into images showing only the text (i.e., pure text), only the halftones (i.e., pure halftone) and only the solid images (i.e., pure solid). Next, for the same printer, to obtain toner mass consumption per pixel and ratio of transition counts/pixel counts for pure halftone the following procedure is used as follows:

(2) Pure Half tone:

Test Pattern to be used: File No. 2

No. of pixels in the file=1.345 millions

Procedure:

Repeat procedures for pure text to obtain the average toner mass consumption per pixel as M2 for define pure halftone and the average ratio of transition counts/pixel counts as R2 for pure half tone.

Similarly, to obtain toner mass consumption per pixel and ratio of transition counts/pixel counts for pure solid areas the following procedure is used as follows:

(3) Pure Solid areas:

Test Pattern to be used: File No. 3

No. of pixels in the file=1.345 millions

Procedure:

Repeat procedures for pure text to obtain the average toner mass consumption per pixel as M3 for pure halftone and the average ratio of transition counts/pixel counts as R3 for pure half tone To verify the toner mass consumption per pixel for each type of images using standard test pattern the following procedure having steps (a) through (g) is used:

Test Pattern to be used: File No. 4 (Standard Test Pattern)

No. of pixels in the file=1.345 Millions

By way of example and for purposes of illustration, in a standard test pattern:

(1) % of text in the standard pattern=76.17%

No. of pixels in text type=1.0214 Millions (2) % of half tone in the standard pattern=5.28%

No. of pixels in half tone type=0.0708 millions (3) % of solid areas in the standard test pattern=18.55%

No. of pixels in solid areas type=0.2488 Millions

Procedure:

(a) Weigh the CRU before beginning experiment.

(b) Print 1,000 prints on Letter/A4 size paper.

(c) Weigh the CRU after completing 1,000 prints.

(d) After the test, obtain the number of pixel counts and transition counts and determine the ratio of transition count/pixel count (e) Obtain the toner mass consumption per 1,000 prints then toner mass consumption for one print and then toner mass consumption per pixel (Toner mass consumption per print divided by number of pixels per print) in Ng (nanogram: $10^{-9}$ gram) per pixel.

(f) Repeat (a) through (e) 5 times and obtain the average toner mass consumption per pixel as M4 and the average ratio of transition count/pixel count as R4.

To verify the accuracy of toner consumption per pixel for each type of images the following equation can be used:

1.0214 millions*M1+0.0708 millions*M2+0.2488 millions*M3=Actual toner mass consumption by one print of standard test pattern 1.

Referring to FIG. 2A, a simple look up table 40 is generated from the above experiment having the ratio of transitions/pixel counts 42 and toner mass/pixel 43 versus images. The ratio of transition counts/pixel counts 42 is expected to be in the following order: Pure Solid areas (44) less than Pure Text/line (46) which is less than Pure Half tone/gray scale (48). To obtain more accurate results, reference to FIG. 2B, there is illustrated a refined look up table 50 having ratio of transitions/pixel counts 42, toner mass/pixel 43 and an assigned look up number 55 versus broader (Mixed image types with different percentages) solid 44, text 46 and half tone 48 images. The numbers R1, R2, R3, R4 and M1, M2, M3, M4 are determined experimentally. The numbers under 1, 3, 6, 7 and 9 can be calculated proportionally with respect to the experimental values. FIG. 2C shows table 60 which illustrates how the table 50 of FIG. 2B would look like after all the values have been determined (the numbers shown are arbitrary numbers for example only). If necessary, the table can be further refined. These numbers (values) may be stored in the controller or other non-volatile memory (NVM) within the printer.

Also the toner cartridge 20 is received pre-filled with a specified (known constant) initial amount of toner, which is known to the printer 10 in this system. That number may be stored as a pixel count or an actual toner weight in the controller 16. The CRUM 28 itself is an EEPROM and can be coded or wired to so read and indicate when it is plugged into the printer 10. The following procedure (a) through (e) using the experimental values may now be used to calculate and estimate toner usage as follows:

(a) Load the required amount of toners in the CRU according to the specific CRU toner life. By way of example, for 10 K CRU, the toner to be loaded=M4*1.345 millions*10,000 grams plus a pre-determined amount of expected unused toner.

(b) After printing a page of random image pattern, the ratio of transition counts/pixel counts is determined and compared to either a look-up table or assigned values located in code to obtain the corresponding toner mass consumption/pixel value.

(c) Multiply this value by the pixel counts of this page to obtain the toner mass consumption for this page.

(d) Subtract this toner mass consumption value from the total or previous toner mass left in the CRU to obtain the new remaining toner mass. This value is expressed by the % of remaining toner.

(e) When the toner remaining percent (%) value obtained is not consistent with the real toner mass left after generating different image patterns, deletion results when toner remaining percent (%) still shows toner left, the assigned values in code or in a look up table are needed to be modified until consistence is achieved.

As each page is printed, the pixel count and transition count are monitored for that page in FPGA. These counts are read by the controller and using the pre-determined values of the ratio of transition count/pixel count, an estimation of the average image type (half tone, text and solid area) is determined for that page. The number of pixels for that page is then multiplied by the pre-determined toner mass per pixel for that image type. The resulting calculated toner amount is subtracted from the previous remaining balance of toner. This new toner remaining percentage value is saved and transmitted to and stored in the CRUM. After the pixel count and transition count are read by the controller, FPGA will reset for the next job. This process continues until the warning level for remaining toner is attained ("Low Toner" signal). The user is then alerted that the toner is nearing its "end-of-life" condition. The process continues until a calculated remaining toner percentage of zero is attained, which should coincide with the toner cartridge being empty. That is, continuously subtracting calculated toner usage this way (with printer imaging) from the known initial installed toner amount or previously calculated remaining amount until the balance amount reaches zero automatically gives an "out of toner" indication, without ever actually sensing or examining the toner container itself.

The method disclosed herein can provide substantial hardware cost savings, and repair or maintenance cost savings, as compared to other "low toner" or "out of toner" sensor systems which require optical, sonic, torque, weight or other sensors in or associated with the toner supply or dispenser, and associated wiring.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A method, comprising:

calculating a ratio of transition count/pixel count using a pixel transition count and a pixel count for a printed image; and providing an estimate of toner consumption based on said ratio of transition count/pixel count.

2. The method according to claim 1, further comprising:

counting said pixel count and said pixel transition count per page using a field programmable gate array.

3. The method according to claim 2, further comprising:

using a pixel counter register in said field programmable gate array wherein said pixel counter keeps track "On" pixel on a page.

4. The method according to claim 2, further comprising:

using a transition counter register in said field programmable gate array wherein said transition counter register counts only "1 to 0" or "0 to 1" transition in horizontal scan direction using video data being sent to a print engine.

5. The method according to claim 1, further comprising:

providing said estimate toner usage by determining predetermined toner consumption per pixel value based on counting pixels and measuring toner usage for different types of images.

6. The method according to claim 5, further comprising:

storing said predetermined toner consumption per pixel values in a printer controller.

7. The method for providing said estimate toner usage by determining predetermined toner consumption per pixel value according to claim 5, further comprising:

(a) weighing a toner cartridge replaceable unit;

(b) printing a predetermined amount of prints for a given size paper;

(c) weighing the cartridge replaceable unit after finishing said predetermined amount of prints;

(d) calculating toner mass consumption for said predetermined amount of prints and toner mass consumption for one print wherein toner mass consumption per pixel is calculated by said toner mass consumption per print divided by number of pixels per print;

(e) repeat (a) through (d) a predetermined number of times and calculate an average toner mass consumption per pixel;

(f) calculate a ratio of transition counts/pixel counts; and (g) repeat (a) through (f) a predetermined number of times and calculate average ratio of transition counts/pixel counts and assign said toner mass consumption per pixel value to said average ratio of transition counts/pixel counts.

8. The method according to claim 7, further comprising:

determining said average ratio of transition counts/pixel counts/pixel counts for pure text, pure halftone and pure solid areas.

9. A method for estimation of toner usage comprising:

calculating a ratio of transition count/pixel count per page determined from pixel counts and transition counts using a controller in the printer;

obtaining toner mass consumption per page by multiplying pixel counts by a predetermined consumption per pixel value based on said ratio of transition count/pixel count per page; and subtracting said toner mass consumption value from previous toner mass left in the cartridge to obtaining remaining toner mass and storing in memory; and calculating and transmitting toner remaining as percentage data to a customer replaceable unit monitor.

10. The method for estimation of toner usage according to claim 9, further comprising:

calculating said pixel count and said pixel transition count per page using a field programmable gate array.

11. The method for estimation of toner usage according to claim 10, further comprising:

using a pixel counter register in said field programmable gate array wherein said pixel counter keeps track "On" pixel on a page.

12. The method for estimation of toner usage according to claim 10, further comprising:

using a transition counter register in said field programmable gate array wherein said transition counter register counts only "1 to 0" or "0 to 1" transition in horizontal scan direction using video data being sent to a print engine.

13. The method for estimation of toner usage according to claim 10, further comprising:

determining for different types of images a predetermined consumption per pixel value based on counting pixels and measuring toner usage for each type of image.

14. The method for estimation of toner usage according to claim 13, further comprising:

storing for each type of image said predetermined consumption per pixel values memory of said controller.

15. The method for estimation of toner usage according to claim 10, further comprising:

(a) weighing a cartridge replaceable unit;

(b) printing a predetermined amount of prints for a given size paper;

(c) weighing the cartridge replaceable unit after finishing said predetermined amount of prints;

(d) calculating toner mass consumption for said predetermined amount of prints and toner mass consumption for one print wherein toner mass consumption per pixel is calculated by said toner mass consumption per print divided by number of pixels per print;

(e) repeat (a) through (d) a predetermined number of times and calculate an average toner mass consumption per pixel;

(f) calculate a ratio of transition counts/pixel counts; and (g) repeat (a) through (f) a predetermined number of times and calculate an average ratio of transition counts/pixel counts and assign said toner mass consumption per pixel value to said average ratio of transition counts/pixel counts.

16. The method for estimation of toner usage according to claim 15, further comprising:

determining said average ratio of transition counts/pixel counts for pure text, pure halftone and pure solid areas.

17. The method for estimation of toner usage comprising: obtaining toner mass consumption per page by multiplying pixel counts by a predetermined consumption per pixel value based on a ratio of transition count/pixel count per page; and subtracting said toner mass consumption value from previous toner mass left in the cartridge to obtaining remaining toner mass and storing in memory; and calculating and transmitting toner remaining as percentage data to a customer replaceable unit monitor.

18. The method for estimation of toner usage according to claim 17, further comprising:

calculating said ratio of transition count/pixel count per page determined by counting pixel counts and transition counts using a controller in the printer.

19. The method for estimation of toner usage according to claim 18, further comprising:

using a pixel counter register and a transition counter register in a field programmable gate array wherein said pixel counter keeps track "On" pixel on a page and said transition counter register counts only "1 to 0" or "0 to 1" transition in horizontal scan direction using video data being sent to a print engine.

20. The method for estimation of toner usage according to claim 17, further comprising:

(a) weighing a cartridge replaceable unit;

(b) printing a predetermined amount of prints for a given size paper;

(c) weighing the cartridge replaceable unit after finishing said predetermined amount of prints;

(d) calculating toner mass consumption for said predetermined amount of prints and toner mass consumption for one print wherein toner mass consumption per pixel is calculated by said toner mass consumption per print divided by number of pixels per print;

(e) repeat (a) through (d) a predetermined number of times and calculate an average toner mass consumption per pixel;

(f) calculate a ratio of transition counts/pixel counts; and (g) repeat (a) through (f) a predetermined number of times and calculate an average ratio of transition counts/pixel counts and assign said toner mass consumption per pixel value to said average ratio of transition counts/pixel counts.

21. A printer, comprising:

a logic circuit for calculating a ratio of transition count/pixel count using a pixel transition count and a pixel count for a printed image; and a controller for estimating toner consumption based on said ratio of transition count/pixel count.

22. The printer according to claim 21 wherein said logic circuit is a field-programmable gate array.

* * * * *